US009003787B2

(12) United States Patent
Katayama et al.

(10) Patent No.: US 9,003,787 B2
(45) Date of Patent: Apr. 14, 2015

(54) CONTROL APPARATUS AND CONTROL METHOD FOR STIRLING ENGINE

(75) Inventors: Masaaki Katayama, Susono (JP); Manabu Tateno, Shizuoka-ken (JP); Satoshi Komori, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 273 days.

(21) Appl. No.: 13/588,405

(22) Filed: Aug. 17, 2012

(65) Prior Publication Data

US 2013/0047602 A1 Feb. 28, 2013

(30) Foreign Application Priority Data

Aug. 22, 2011 (JP) ..... 2011-180861

(51) Int. Cl.
*F01B 29/10* (2006.01)
*F02G 1/045* (2006.01)

(52) U.S. Cl.
CPC ..... *F02G 1/045* (2013.01); *F02G 2275/40* (2013.01)

(58) Field of Classification Search
CPC ..... F02G 1/045; F02G 2275/40
USPC ..... 60/517–526, 646, 657
See application file for complete search history.

(56) References Cited

U.S. PATENT DOCUMENTS

| | | | | | |
|---|---|---|---|---|---|
| 3,458,995 | A * | 8/1969 | Brandes et al. | ..... | 60/524 |
| 4,738,106 | A * | 4/1988 | Yamaguchi | ..... | 60/521 |
| 5,095,701 | A * | 3/1992 | Nakano | ..... | 60/521 |
| 2010/0139263 | A1 * | 6/2010 | Katayama et al. | ..... | 60/526 |

FOREIGN PATENT DOCUMENTS

| | | | |
|---|---|---|---|
| JP | 62-247160 | A | 10/1987 |
| JP | 06-147068 | A | 5/1994 |
| JP | 2004-301102 | A | 10/2004 |
| JP | 2004-360661 | A | 12/2004 |
| JP | 2010-255548 | A | 11/2010 |

* cited by examiner

*Primary Examiner* — Hoang Nguyen
(74) *Attorney, Agent, or Firm* — Gifford, Krass, Sprinkle, Anderson & Citkowski, P.C.

(57) ABSTRACT

An ECU is used for a Stirling engine that is provided with a starter that drives an output shaft of the Stirling engine. The ECU includes a control portion that commences an engine-starting drive of the starter within a phase interval, during which the torque of the Stirling engine that varies according to phase of the output shaft is relatively small. The phase interval is an interval during which the torque of the Stirling engine is less than or equal to the torque obtained when the compression begins. The phase at which the driving of the starter is commenced is set to the phase at which the torque of the Stirling engine becomes smaller than the torque obtained when the compression begins.

15 Claims, 3 Drawing Sheets

CONTROL APPARATUS AND CONTROL METHOD FOR STIRLING ENGINE

CROSS REFERENCE TO RELATED APPLICATIONS

This application claims priority to Japanese Patent Application No. 2011-180861 filed on Aug. 22, 2011, which is incorporated herein by reference in its entirety including the specification, drawings and abstract.

BACKGROUND OF THE INVENTION

1. Field of the Invention

The invention relates to a control apparatus and control method for a Stirling engine and, more particularly, to a control apparatus and control method for starting a Stirling engine.

2. Description of Related Art

Technologies related to the starting of a Stirling engine are disclosed in, for example. Japanese Patent Application Publication No. 62-247160 (JP 62-247160 A) and Japanese Patent Application Publication No. 2004-301102 (JP 2004-301102 A). As technologies considered to be relevant to the invention, technologies related to the starting of an engine are disclosed in, for example, Japanese Patent Application Publication No. 2010-255548 (JP 2010-255548 A), Japanese Patent Application Publication No. 2004-360661 (JP 2004-360661 A), and Japanese Patent Application Publication No. 6-147068 (JP 6-147068 A).

If the maximum torque that can be produced by a Stirling engine is smaller than the torque needed to start the engine, it is impossible to start the Stirling engine by itself. Therefore, the starting of a Stirling engine is assisted by using a starter that drives an output shaft of the Stirling engine. However, if the driving of the starter is commenced without any special arrangement, a case can occur where large compression force acts on a piston, depending on the phase of the output shaft in some cases. Then, there arises a need to produce an engine-starting torque that is large enough to start engine even in such a case, by using the starter. This leads to an increase in the size and weight of the starter. In addition, increased cost may also result.

SUMMARY OF THE INVENTION

The invention provides a control apparatus and control method for a Stirling engine which are capable of reducing the engine-starting torque that the starter needs to produce in the starting of the Stirling engine.

A control apparatus for a Stirling engine in accordance with a First aspect of the invention includes: a starter that drives an output shaft of the Stirling engine; and a control portion commencing an engine-starting drive of the starter within a phase interval, during which torque of the Stirling engine that varies according to phase of the output shaft is relatively small.

In the first aspect of the invention, the control portion may drive the starter with torque that is smaller than a torque required at time of the engine-starting drive, until the phase of the output shaft reaches the phase at which the engine-starting drive is commenced.

Furthermore, in the first aspect of the invention, the control portion may re-drive the starter if it is determined that the re-driving of the starter is necessary, after the engine-starting drive has caused the phase of the output shaft to be outside the phase interval.

Still further, in the first aspect of the invention, the control portion may re-drive the starter if it is determined that the torque of the Stirling engine does not become greater than the torque obtained at a local maximum point of a torque curve within the phase interval in a subsequent cycle of the Stirling engine provided that the starter is not re-driven, after the phase of the output shaft has passed the local maximum point.

Yet further, in the first aspect of the invention, the local maximum point may be one that results from an action of compressing working fluid which is performed by the Stirling engine.

A control method for a Stirling engine in accordance with a second aspect of the invention includes: commencing an engine-starting drive of the starter within a phase interval, during which torque of the Stirling engine that varies according to phase of the output shaft is relatively small.

According to the invention, in the starting of the Stirling engine, the engine-starting torque that needs to be produced by the starter can be restrained.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Embodiments of the invention will be described with reference to the drawings.

Figure 1:
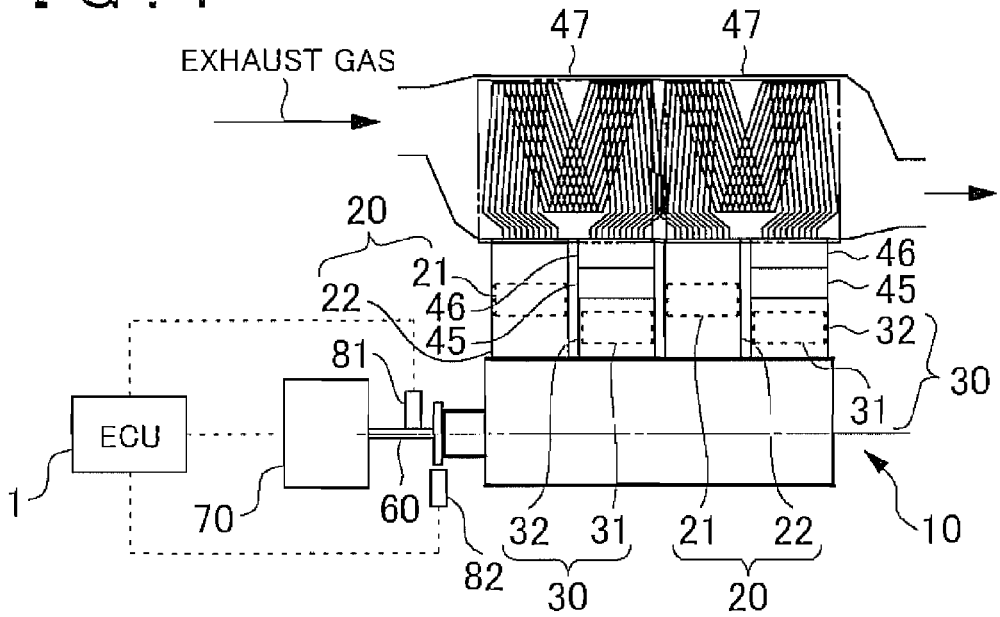
FIG. 1 is an overall diagram of various constructions that include a Stirling engine.

FIG. 1 is an overall diagram of various constructions that include a Stirling engine 10. The constructions shown in FIG. 1 are mounted in a vehicle (not shown). The Stirling engine 10 has high-temperature-side cylinder units 20 and low-temperature-side cylinder units 30 that are disposed in a inline-parallel arrangement. The Stirling engine 10 has a plurality of pairs (two pairs in this example) of cylinders 20 and 30 for an output shaft 60. Thus, the Stirling engine 10 is a multi-cylinder $\alpha$ type Stirling engine that has four cylinders.

Each high-temperature-side cylinder unit 20 includes an expansion piston 21 and a high-temperature-side cylinder 22. Each low-temperature-side cylinder unit 30 includes a compression piston 31 and a low-temperature-side cylinder 32. A phase difference, between the compression piston 31 and the corresponding expansion piston 21 is provided such that the compression piston 31 moves approximately 90° in crank angle behind the expansion piston 21. Furthermore, there, is a predetermined phase difference between the two compression pistons 31. The pistons 21 and 31 are linked to the output shall 60 viva link mechanism. The reciprocating movements of the pistons 21 and 31 are converted into rotating motion by the output shaft 60.

An upper space in the high-temperature-side cylinder unit 20 is provided as an expansion space. Working fluid having been heated by a heater 47 flows into the expansion space. A heater 47 carries out heat exchange between the working fluid and exhaust gas of an internal combustion engine both of which are in flowing movements. Thus, the working fluid is heated by the thermal energy recovered from exhaust gas. Concretely, the heater 47 is a multi-pipe heat exchanger, and the exhaust gas of the internal combustion engine constitutes a high-temperature heat source of the Stirling engine 10.

An upper space in the low-temperature-side cylinder unit 30 is a compression space. The working fluid having been cooled by a cooler 45 flows into the compression space. A regenerator 46 carries out heat exchange with the working fluid that moves back and forth between the expansion space and the compression space. Specifically, the regenerator 46 receives heat from the working fluid when the working fluid flows from the expansion space to the compression space, and the regenerator 46 releases stored heat to the working fluid when the working fluid flows from the compression space to the expansion space. The working fluid used in this example is air. However, the working fluid is not limited to air, but may also be a gas, for example, He (helium), $H_2$ (hydrogen), $N_2$ (nitrogen), etc.

Next, operations of the Stirling engine 10 will be described. As the heater 47 heats the working fluid, the working fluid expands and therefore presses the expansion piston 21 down. Due to this motion, the output shall 60 rotates. Then, when the expansion piston 21 enters the ascent stroke, the working fluid passes through the heater 47, and is brought to the regenerator 46. The working fluid releases heat to the regenerator 46, and then flows into the cooler 45. After being cooled by the cooler 45, the working fluid flows into the compression space. Then, the working fluid is compressed as the compression piston 31 ascends. The working fluid compressed in this manner then takes heat from the regenerator 46 so that the temperature of the working fluid rises. Then, the working fluid flows into the heater 47. The working fluid is then heated again to expand. The Stirling engine 10 operates through the above-described back-and-forth movements of the working fluid.

In the Stirling engine 10, gas lubrication is employed between the cylinders 22 and 32 and the corresponding pistons 21 and 31. In the gas lubrication, the pressure (distribution) of air that occurs in small clearances between the cylinders 22 and 32 and the corresponding pistons 21 and 31 is utilized to have the pistons 21 and 31 floating in air. In this example, the gas lubrication whereby an object is floated in air may be, for example, static-pressure gas lubrication in which an object is floated by static pressure produced by jetting pressurized fluid. However, the gas lubrication is not limited to this, but may also be, for example, dynamic-pressure gas lubrication.

The output shaft 60 is provided with a starter 70. The starter 70 is provided to assist in the starting of the Stirling engine 10 since the maximum torque that can be produced by the Stirling engine 10 is smaller than the torque needed to start the engine. The starter 70 functions as a drive motor that drives the output shaft 60 when supplied with electric power, and also functions as an electricity generator that is driven by the output shaft 60. The starter 70 may also be a unit separate from the electricity generator. The output shaft 60 is also provided with a phase detection sensor 81 that is able to detect that the phase of the output shaft 60 is a predetermined phase, and a rotation speed sensor 82 capable of detecting the crank angle that is the phase of the output shaft 60.

An ECU 1 is an electronic control unit that corresponds to a control apparatus for the Stirling engine, and includes a microcomputer made up of a CPU, a ROM, a RAM, etc. The ECU 1 is electrically connected to various sensors, switches and the like, including the phase detection switch 81 and the rotation speed sensor 82. Furthermore, the ECU 1 is electrically connected to the starter 70 as a control object. The ECU 1 is able to detect the torque of the starter 70 by detecting the electric power of the starter 70.

A ROM is a component for storing programs in which various processes that the CPU executes are written as well as map data and the like. Due to the CPU executing processes by using temporary storage areas in the RAM according to need on the basis of programs stored in the ROM, the ECU 1 realizes various functional portions, for example, a control portion described below.

Figure 2:
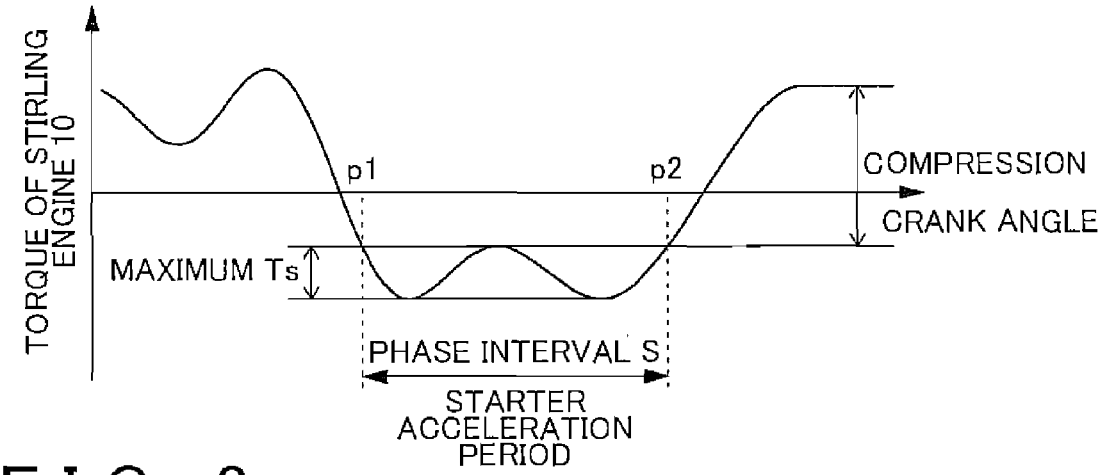
FIG. 2 is a diagram showing torque variation of the Stirling engine.

The control portion, in the starting of the Stirling engine 10, commences the engine-starting driving of the starter 70 within a phase interval S during which the torque of the Stirling engine 10, which varies according to the crank angle, is relatively small. FIG. 2 is a diagram showing torque variation of the Stirling engine 10. In FIG. 2, the vertical axis shows the torque of the Stirling engine 10, and the horizontal axis shows the crank angle. As for the Stirling engine 10, since the torque changes according to the crank angle, each engine cycle includes a phase interval during which the torque is relatively high and the phase interval S during which the toque is relatively low.

Concretely, the phase interval S is set as an interval during which the torque of the Stirling engine 10 is less than or equal to the torque obtained when the working fluid begins to be compressed by the compression piston 31. A commencement phase p1 at which the engine-starting driving of the starter 70 is commenced is set to a phase at which the torque of the Stirling engine 10 becomes lower than the torque obtained when the compression begins. An end phase p2 at which the engine-starting driving of the starter 70 ends is set to a phase at which the compression begins.

The commencement phase p1 may be, for example, a phase at which the torque of the Stirling engine 10 becomes smaller than the torque obtained when the compression begins. The end phase p2 may be, for example, a phase that is advanced from the phase at which the compression begins. In this respect, as for the commencement of the engine-starting driving of the starter 70 within the phase interval S, the control portion can cause the engine-starling driving of the starter 70, within a period corresponding to at least a partial interval of the phase interval S.

When the engine-starting driving of the starter 70 is to be caused, the control portion drives the starter 70 with an engine-starting torque Ts that has such a magnitude that the Stirling engine 10 can be started. This makes it possible for the torque of the Stirling engine 10 to surpass the local-maximum-point torque that appears according to the working fluid-compressing action that the Stirling engine 10 performs. That is, it becomes possible for the phase of the output shaft 60 of the Stirling engine 10 to pass the local maximum point of the torque curve within the phase interval S. In this respect, more concretely, the control portion drives the starter 70 so that the sum of the engine-starting torque Ts and the rotational kinetic energy of the output shaft 60 becomes greater than or equal to the work of compression provided that the engine-starting torque Ts produced is less than or equal to the maximum torque that the Stirling engine 10 can produce, during a acceleration period of the starter 70 that is set to the phase interval S.

Figure 3:
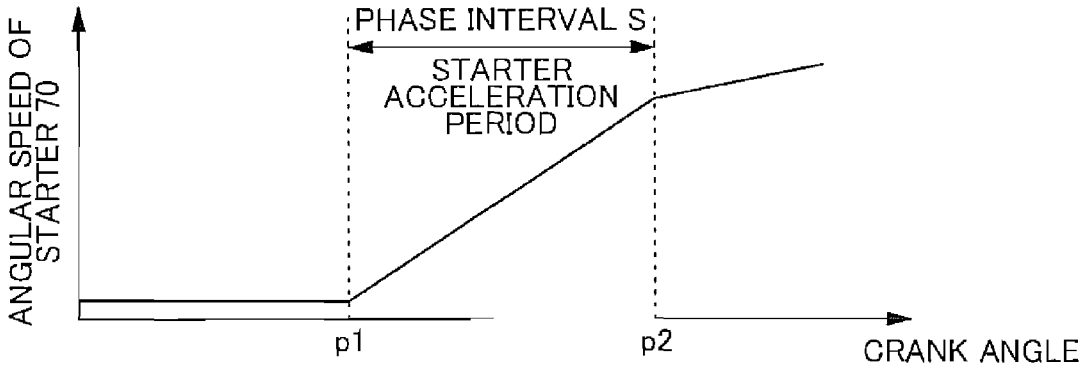
FIG. 3 is a diagram showing changes in the angular speed of a starter.

The control portion further drives the starter 70 with torque that is smaller than the engine-starting torque Ts, until the crank angle reaches the commencement phase p1. FIG. 3 is a diagram showing changes in the angular speed of the starter 70. As shown in FIG. 3, the angular speed of the starter 70 is kept at a very low constant value of speed during a period until the crank angle reaches the commencement phase p1, because the starter 70 is driven with torque that is smaller than the engine-starting torque Ts dining that period. After the crank angle reaches the commencement phase p1, the starter 70 is accelerated in the starter acceleration period of the starter 70 by the engine-starting driving of the starter 70 that is performed within a period corresponding to the phase interval S.

Figure 4:
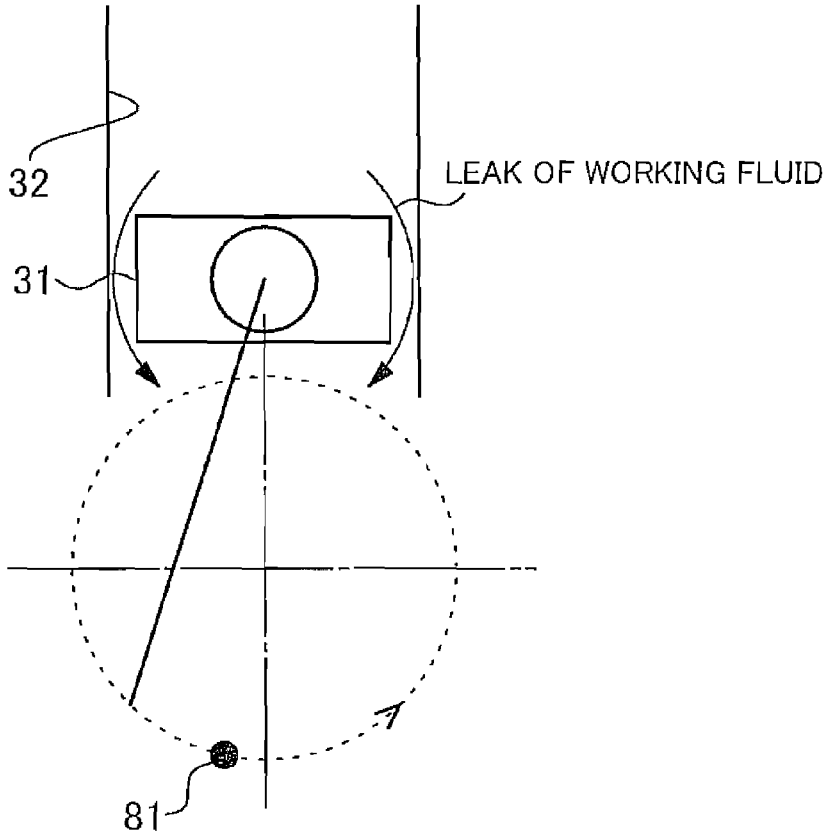
FIG. 4 is a diagram showing a situation of a compression piston at the time of low-speed operation.

FIG. 4 is a diagram showing the situation of the compression piston 31 at the time of low-speed operation of the Stirling engine 10. In the Stirling engine 10, gas lubrication is implemented between the compression piston 31 and the corresponding low-temperature-side cylinder 32 in each low-temperature-side cylinder unit 30. Therefore, by causing the compressing action of the compression piston 31 at very low speed, the work fluid can be caused to flow out through the clearance between the compression piston 31 and the corresponding low-temperature-side cylinder 32. Concretely, the phase detection sensor 81 is provided so as to be able to detect that the phase of the output shaft 60 is the commencement phase p1, when the output shaft 60 rotates at very low speed. The torque produced during the period until the crank angle reaches the commencement phase p1 is concretely a torque such that progress of the compression of the working fluid by the compression piston 31 is restrained and such that the crank angle can be changed.

Furthermore, after, in accordance with the engine-starting driving of the starter 70, the torque of the Stirling engine 10 successfully becomes greater than the local-maximum-point torque that appears according to the working fluid-compressing action, the control portion drives the starter 70 again if it is determined that the local-maximum-point torque that appears according to the working fluid-compressing action cannot be surpassed (or provided) in the next cycle without re-driving the starter 70. Concretely, at this time the control portion re-drives the starter 70 in the engine-starting drive mode. As for the re-driving of the starter 70 in the engine-starting drive mode, an arrangement may be made, for example, such that the engine-starting driving of the starter 70 is carried out within a period corresponding to the phase interval S when the crank angle reaches the commencement phase p1 again.

Figure 5A:
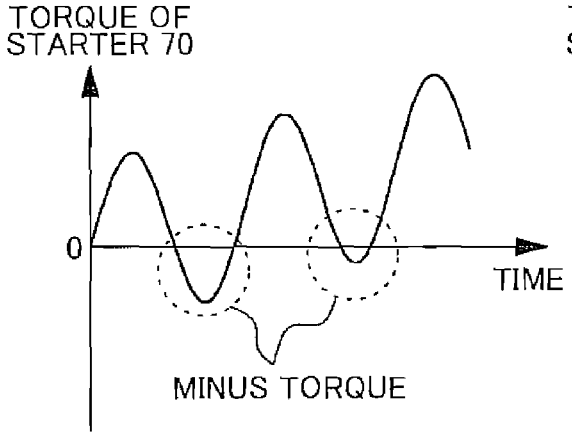
FIG. 5A is a diagram showing an example of changes in the torque of a starter.
Figure 5B:
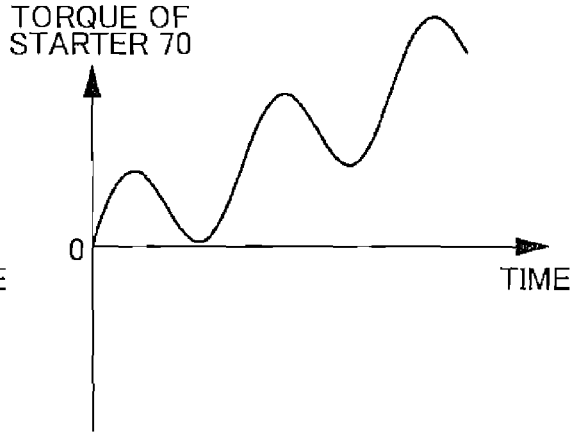
FIG. 5B is a diagram showing another example of changes in the torque of the starter.

FIGS. 5A and 5B are diagrams each showing an example of changes in the torque of the starter 70 that can be produced at the time of starting the Stirling engine 10. FIG. 5A shows a case where the re-driving of the starter 70 in the engine-starting drive mode is necessary. FIG. 5B shows a case where the re-driving of the starter 70 in the engine-starting drive mode is not necessary as a reference in contrast with the case shown in FIG. 5A. The case where it is determined that the torque of the Stirling engine 10 cannot surpass the local-maximum-point torque that appears according to the working fluid-compressing action is concretely a case where it is determined that, as shown in FIG. 5A, the value of the torque of the starter 70 changes from minus to plus, and then changes to minus again.

Whether the value of torque of the starter 70 changes to minus again can be determined on the basis oil for example, determination as to whether, on the torque curve of the starter 70, the value obtained by subtracting, from the local maximum value that appears immediately prior to the local minimum value that can serve as an object considered in the determination as to whether the value of torque of the starter 70 is to change to minus again, the torque difference that is immediately previously made by the change from the local maximum value to the local minimum value of torque of the starter 70 is a negative value. Local maximum values and local minimum values as mentioned above can be detected by providing a phase detection sensor corresponding, to the phases at which those values appear, and then by detecting the torque produced by the starter 70 when the phase detection sensor detects any one of the phases.

It can be determined on the basis of, for example, the determination that the value of torque of the starter 70 has changed to minus again, that the torque of the Stirling engine 10 cannot surpass the local-maximum-point torque that appears according to the working fluid-compressing action. In this case, as for the re-driving of the starter 70, the engine-starting driving of the starter 70 can be performed, for example, by setting the commencement phase p1 to the phase at which the value of torque of the starter 70 changes to minus again and setting the end phase p2 to the phase at which the value of torque of the Stirling engine 10 becomes equal to the value of torque obtained when the compression is commenced. When the engine-starting driving of the starter 70 is performed again, the magnitude of the engine-starting torque Ts itself may be different from the magnitude of the engine-starting torque obtained when the engine-starting operation is performed for the first time.

Figure 6:
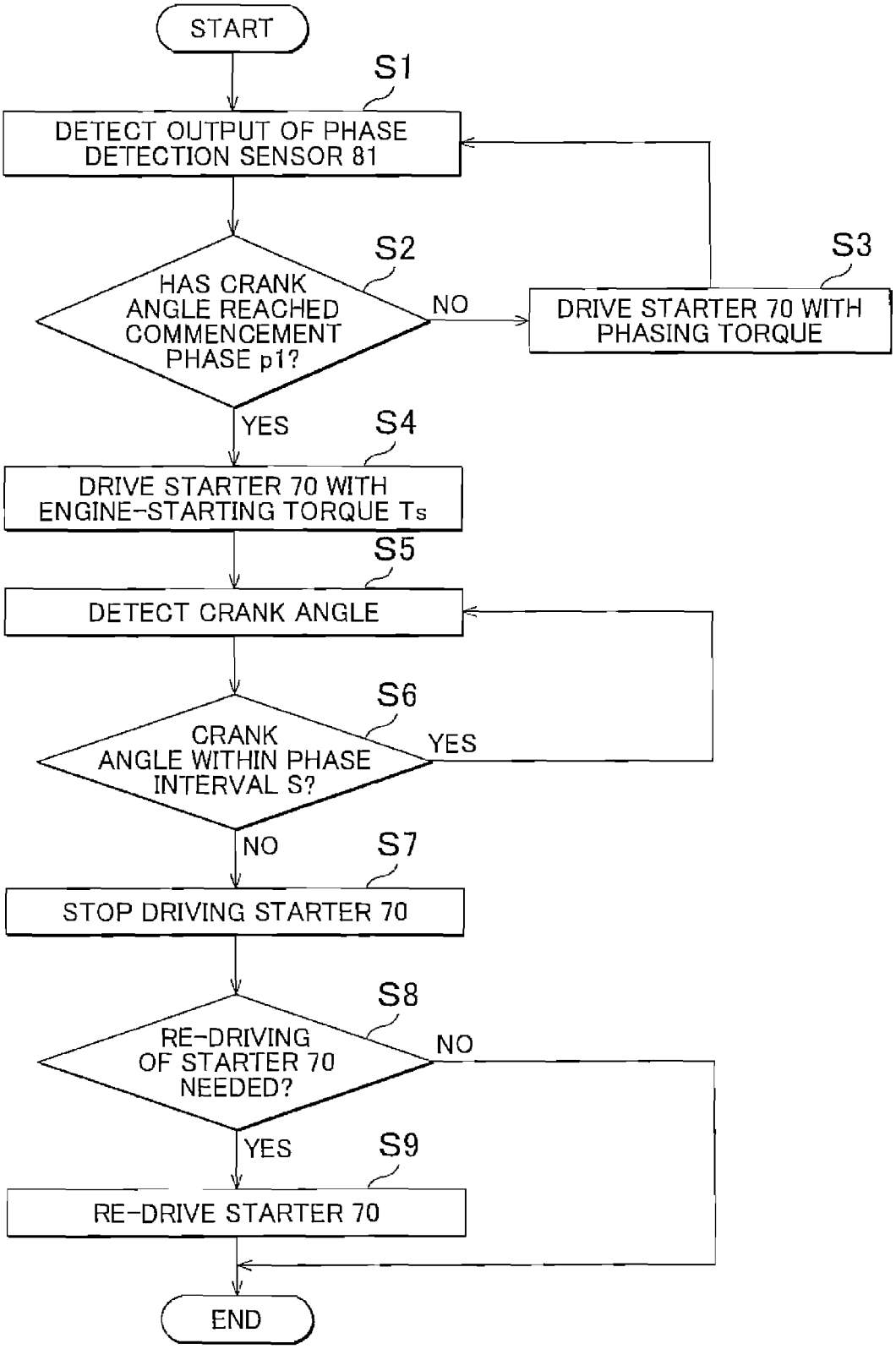
FIG. 6 is a diagram showing an operation of an ECU in a flowchart.

An operation of the ECU 1 will be described below with reference to the flowchart shown in FIG. 6. The operation shown by this flowchart can be commenced when in the starting of the Stirling engine 10, a predetermined engine-starting condition (e.g., a condition that the warm-up of the Stirling engine 10 has progressed to a predetermined state so that the self-sustaining operation of the Stirling engine 10 is possible) is satisfied.

The ECU 1 detects the output of the phase detection sensor 81 (step S1). Then, the ECU 1 determines whether the crank angle has reached the commencement phase p1 (step S2). If a negative determination is made in step S2, the ECU 1 drives the starter 70 with torque (torque for a phasing purpose) that is smaller than the engine-starting torque Ts (step S3). After step S3, the process returns to step S1. Thus, the starter 70 is driven with the phasing torque until an affirmative determination is made in step S2.

If an affirmative determination is made in step S2, the ECU 1 drives the starter 70 with the engine-starting torque is (step S4). Thus, the engine-starting driving of the starter 70 within the phase interval S commences. Subsequently, the ECU 1 detects the crank angle (step S5), and then determines whether the crank angle is within the phase interval S (step S6). If the determination in step S6 is affirmative, the process returns to step S5. On the other hand, if the determination is negative, the ECU 1 stops the driving of the starter 70 (step S7). This ends the engine-starting driving of the starter 70 that is performed within a period corresponding to the phase interval S. Incidentally, to stop the driving of the starter 70, it is also permissible to detect the end phase p2, for example, by substantially the same method as that for detecting the commencement phase p1.

Subsequently to step S7, the ECU 1 determines whether the starter 70 needs to be re-driven (step S8). In the determination as to whether the re-driving of the starter 70 is needed, necessary processes may be appropriately incorporated, for example, detection of the torque of the starter 70, or the like, prior to step S8. If the determination in step S8 is affirmative, the ECU 1 re-drives the starter 70 (step S9). As for the re-driving of the starter 70, an arrangement may be made, for example, such that when the crank angle reaches the commencement phase p1 again, the engine-starting driving of the starter 70 can be performed within a period corresponding to the phase interval S. After a negative determination is made in step S8, or after step S9, the operation of the flowchart ends.

Effects of the ECU 1 will be described. In the starting of the Stirling engine 10, the ECU 1 commences the engine-starting driving of the starter 70 within the phase interval S. Therefore, the ECU 1 carries out the starting of the Stirling engine 10 by accelerating the starter 70 during the state in which the torque of the Stirling engine 10 is relatively small and thereby storing rotational kinetic energy of the output shaft 60. Therefore, the engine-starting torque Ts that needs to be produced by the starter 70 can be restrained. Therefore, concretely, size increase and weight increase of the starter 70 can be restrained. At the same time, cost increase can also be restrained.

The ECU 1 drives the starter 70 with torque that is smaller than the engine-starting torque Ts until the crank angle reaches the commencement phase p1. Concretely, the starter 70 is driven with a torque such that the crank angle can be changed while the process of the compression of the working fluid by the compression piston 31 is restrained. Then, the engine-starting driving of the starter 70 can be suitably performed, regardless of the initial state of the crank angle.

After, in accordance with the engine-starting driving of the starter 70, the torque of the Stirling engine 10 successfully surpasses the local-maximum-point torque that appears according to the working fluid-compressing action, the ECU 1 re-drives the starter 70 if it is determined that the local-maximum-point torque that appears according to the working fluid-compressing action cannot be surpassed in the next cycle without driving the starter 70 again. Therefore, the ECU 1 is able to more reliably carry out the starting of the Stirling engine 10.

In carrying out the engine-starting driving of the starter 70, the ECU 1 drives the starter 70 so that the sum of the rotational kinetic energy of the output shaft 60 and the engine-starting torque Ts becomes greater than or equal to the work of compression provided that the engine-starting torque Ts produced is less than or equal to the maximum torque that the Stirling engine 10 can produce. This makes it possible to restrain the engine-starting torque Ts to a required minimum magnitude. Furthermore, since the ECU 1 carries out the engine-starting driving of the starter 70 within a period corresponding to the phase interval S, securement of the required minimum magnitude of the engine-starting torque Ts can be facilitated.

The ECU 1 is used for the multi-cylinder α type Stirling engine 10 that has lour cylinders. The ECU 1 is suitably used for a multi-cylinder α type Stirling engine that has four or more cylinders in which the difference between the case where the torque that varies according to the crank angle is relatively large and the case where the torque that varies according to the crank angle is relatively small is likely to conspicuously appear.

While embodiments of the invention have been described above, the invention is not limited to any specific embodiment disclosed above, but can be modified or changed in various manners without departing from the gist of the invention described in the appended claims.

What is claimed is:

1. A control apparatus for a Stirling engine, comprising:

a starter that drives an output shaft of the Stirling engine, in each cycle of the Stirling engine a torque required to start the Stirling engine varies according to a phase of the output shaft; and a control portion that commencing an engine-starting drive of the starter within a phase interval of the output shaft during a cycle of the Stirling engine, in the phase interval the torque required to start the Stirling engine is relatively small.

2. The control apparatus according to claim 1, wherein the control portion drives the starter with torque that is smaller than a torque required at time of the engine-starting drive, until the phase of the output shaft reaches the phase at which the engine-starting drive is commenced.

3. The control apparatus according to claim 1, wherein the control portion re-drives the starter if it is determined that the re-driving of the starter is necessary, after the engine-starting drive has caused the phase of the output shaft to be outside the phase interval.

4. The control apparatus according to claim 1, wherein the control portion re-drives the starter if it is determined that the torque of the Stirling engine does not become greater than the torque obtained at a local maximum point of a torque curve within the phase interval in a subsequent cycle of the Stirling engine if the starter is not re-driven, after the phase of the output shaft has passed the local maximum point.

5. The control apparatus according to claim 4, wherein the local maximum point results from an action of compressing working fluid which is performed by the Stirling engine.

6. A control method for a Stirling engine having a starter that drives an output shaft of the Stirling engine, in each cycle of the Stirling engine a torque required to start the Stirling engine varies according to a phase of the output shaft, comprising:

commencing an engine-starting drive of the starter within a phase interval of the output shaft during of a cycle of the Stirling engine, in the phase interval the torque required to start the Stirling engine is relatively small.

7. The control apparatus according to claim 2, wherein the control portion re-drives the starter if it is determined that the re-driving of the starter is necessary, after the engine-starting drive has caused the phase of the output shaft to be outside the phase interval.

8. The control apparatus according to claim 2, wherein the control portion re-drives the starter if it is determined that the torque of the Stirling engine does not become greater than the torque obtained at a local maximum point of a torque curve within the phase interval in a subsequent cycle of the Stirling engine if the starter is not re-driven, after the phase of the output shaft has passed the local maximum point.

9. The control apparatus according to claim 3, wherein the control portion re-drives the starter if it is determined that the torque of the Stirling engine does not become greater than the torque obtained at a local maximum point of a torque curve within the phase interval in a subsequent cycle of the Stirling engine if the starter is not re-driven, after the phase of the output shaft has passed the local maximum point.

10. The control apparatus according to claim 7, wherein the control portion re-drives the starter if it is determined that the torque of the Stirling engine does not become greater than the torque obtained at a local maximum point of a torque curve within the phase interval in a subsequent cycle of the Stirling engine if the starter is not re-driven, after the phase of the output shaft has passed the local maximum point.

11. The control apparatus according to claim 8, wherein the local maximum point results from an action of compressing working fluid which is performed by the Stirling engine.

12. The control apparatus according to claim 9, wherein the local maximum point results from an action of compressing working fluid which is performed by the Stirling engine.

13. The control apparatus according to claim 10, wherein the local maximum point results from an action of compressing working fluid which is performed by the Stirling engine.

14. A control apparatus for a Stirling engine, comprising:

a starter that drives an output shaft of the Stirling engine; and a control portion that commencing an engine-starting drive of the starter within a phase interval, during which torque of the Stirling engine that varies according to phase of the output shaft is relatively small, the control portion re-drives the starter if it is determined that the torque of the Stirling engine does not become greater than the torque obtained at a local maximum point of a torque curve within the phase interval in a subsequent cycle of the Stirling engine if the starter is not re-driven, after the phase of the output shaft has passed the local maximum point.

15. The control apparatus according to claim 14, wherein the local maximum point results from an action of compressing working fluid which is performed by the Stirling engine.

* * * * *